US005890430A

United States Patent [19]

Wirz

[11] Patent Number: 5,890,430

[45] Date of Patent: Apr. 6, 1999

[54] IMPRESSION CYLINDER HAVING A MULTIPLE DIAMETER AND A SHEET GUIDING FOIL

[75] Inventor: Arno Wirz, Bammental, Germany

[73] Assignee: Heidelberger Druckmaschinen AG, Heidelberg, Germany

[21] Appl. No.: 15,400

[22] Filed: Feb. 9, 1993

Related U.S. Application Data

[63] Continuation-in-part of Ser. No. 785,034, Oct. 30, 1991, abandoned.

[30] Foreign Application Priority Data

Nov. 14, 1990 [DE] Germany ..... 40 36 252.3

[51] Int. Cl.[6] ..... B41F 13/18

[52] U.S. Cl. ..... 101/420; 101/422; 101/216

[58] Field of Search ..... 101/212, 216, 101/375, 401.3, 407.1, 420, 422, 475, 217; 29/895.1, 895.21, 895.211

[56] References Cited

U.S. PATENT DOCUMENTS

| | | | |
|---|---|---|---|
| 1,471,895 | 10/1923 | Huebner | 101/475 |
| 2,324,631 | 7/1943 | May | 101/475 |
| 3,430,560 | 3/1969 | Nettleman | 101/407.1 |
| 4,327,135 | 4/1982 | Wirz et al. | 101/422 |
| 4,681,035 | 7/1987 | Kobler et al. | 101/217 |
| 5,042,383 | 8/1991 | Wirz et al. | 101/422 |

FOREIGN PATENT DOCUMENTS

| | | | |
|---|---|---|---|
| 2446188 | 4/1976 | Germany . | |
| 792246 | 3/1958 | United Kingdom | 101/475 |
| 2081178 | 2/1982 | United Kingdom | 101/422 |

*Primary Examiner*—Stephen R. Funk
*Attorney, Agent, or Firm*—Herbert L. Lerner; Laurence A. Greenberg

[57] ABSTRACT

An impression cylinder of a sheet-fed offset printing machine for first form and perfector printing has a multiple diameter and includes a dressing disposed on an outer cylindrical surface thereof for carrying a sheet on a previously printed side thereof, the dressing including a foil having a textured surface for supporting the sheet and having a construction for adjusting to and compensating for inequalities of the impression cylinder, the foil being replaceably fastened on the outer cylindrical surface at least at a sheet carrying region thereof.

4 Claims, 2 Drawing Sheets

IMPRESSION CYLINDER HAVING A MULTIPLE DIAMETER AND A SHEET GUIDING FOIL

CROSS-REFERENCE TO RELATED APPLICATION

This application is a Continuation-in-Part of application Ser. No. 07/785,034, filed Oct. 30, 1991, and now abandoned.

BACKGROUND OF THE INVENTION

1. Field of the Invention

The invention relates to an impression cylinder of a sheet-fed offset printing machine for first form and perfector printing, the impression cylinder having a multiple diameter, i.e. a diameter which is, for example, double or triple the given conventional diameter of a plate or blanket cylinder of such a printing machine, and, more particularly, to such an impression cylinder having a packing or dressing provided on the outer cylindrical surface of the cylinder for carrying a sheet on a previously printed side thereof.

2. Description of the Related Art Including Information Disclosed Under 37 C.F.R. 1.97 to 1.99.

Impression cylinders having double the conventional size and having a chromium-plated, previously ground outer cylindrical surface have become known heretofore. The additive effect of inequalities in the shape of the two halves of the ground cylinder may cause slurring or double printing while the machine is running and, during perfecting, also a redistribution of the previously printed ink so that the impression cylinder has to be washed more often, thereby increasing the consumption of washing solution detrimental to the environment. This has a negative effect upon the quality of the printed product.

Also known heretofore are double-sized impression cylinders which have been subjected to blasting before being chromium-plated and, nevertheless, have relatively rough surfaces, and an even more inadequate accuracy of shape due to the defects in the impression cylinder which is formed of two unlike halves, so that such impression cylinders tend readily to slurring. As soon as the surface begins to wear, the entire impression cylinder has to be replaced, with resulting high costs for material and assembly as well as downtime in the printshop.

British Patent 1,515,342 discloses an impression cylinder with a single diameter having a nickel foil with a textured surface mounted on the outer cylindrical surface thereof, thus dividing the outer cylindrical surface into raised sheet-supporting areas and depressed non-supporting areas so as to minimize the build-up and accumulation of ink on the outer cylindrical surface when it comes into contact with the freshly printed side of a sheet. Foils serving this purpose have become known heretofore from U.S. Pat. No. 4,327,135.

Impression cylinders with a multiple diameter are more difficult to manufacture than cylinders having the conventional given diameter of plate and blanket cylinders. The multiple-diameter impression cylinders have manufacturing tolerances which add to the tolerances of packing plate thicknesses. The result is commonly referred to as summation faults or errors. This especially occurring faults or errors are slight noncircularity or nonroundness or eccentricity. Such deviations are not able to be fully eliminated even with the best manufacturing processes. They cause a shifting and doubling, respectively, of screen dots which results in ghosting or slurring, both for single-rotation as well as for double-rotation cylinders. Color tones are thereby slightly altered and, accordingly, deviate from nominal color tones.

In single-rotation impression cylinders, color-tone shifting, in the case of slight manufacturing errors, is barely able to be noticed, because it occurs the same for all printings. If the slurring or ghosting becomes too great, a counter-control may be effected with the register device and the error may accordingly be minimized or even entirely eliminated.

On the other hand, in the case of impression cylinders having a double diameter, i.e., with two sheet-supporting surfaces, the screen dot shifts of pairs of successive sheets occur very differently, so that even the smallest color shifts are readily apparent. A screen-dot shift caused by eccentric or non-round rotation of a double-diameter cylinder, for example, cannot be eliminated with the register device because a minimizing of the error in the printed image of one of the sheet-supporting surfaces results in an inverse in the error of the other sheet-supporting surface.

SUMMARY OF THE INVENTION

It is accordingly an object of the invention to provide an impression cylinder of multiple diameter in a sheet-fed offset printing machine which ensures a high printing quality even for perfector printing without the accumulation of ink on the outer cylindrical surfaces of the impression cylinder, thereby minimizing the washing time and, in turn, reducing the consumption of washing solution.

With the foregoing and other objects in view, there is provided, in accordance with the invention, an impression cylinder of a sheet-fed offset printing machine for first form and perfector printing, the impression cylinder having a multiple diameter and comprising a dressing disposed on an outer cylindrical surface thereof for carrying a sheet on a previously printed side thereof, the dressing being a foil having a textured surface for supporting the sheet and having means for adjusting to and compensating for inequalities of the impression cylinder, the foil being selectable from a plurality of foils of varying thicknesses and being replaceably fastened on the outer cylindrical surface at least at a sheet carrying region thereof.

In accordance with another feature of the invention, the dressing is formed of a plurality of foils of varying thickness.

In accordance with an added feature of the invention, the foil has a thickness varying from side edge to side edge thereof.

In accordance with an additional feature of the invention, the foil has a thickness varying from leading edge to trailing edge thereof, as viewed in direction of rotation of the impression cylinder.

In accordance with again another feature of the invention, opposite sides of the foil are nonparallel.

In accordance with again a further feature of the invention, the foil disposed on the outer cylindrical surface of the impression cylinder has a thickness at an operating side of the printing machine differing from a thickness thereof at a drive side of the printing machine.

In accordance with another feature of the invention, the foil is formed of a base layer having a high modulus of elasticity and a chromium layer having a textured surface.

In accordance with another aspect of the invention, there are provided, in a sheet-fed offset printing machine for first form and perfector printing having in mutually cooperative engagement, at least one plate cylinder and one blanket cylinder, both of like given diameter, and an impression cylinder having a diameter at least substantially double the given diameter of the plate and the blanket cylinders, respectively, and having an outer cylindrical surface eccentric to said impression cylinder, and a dressing disposed on the outer cylindrical surface for carrying a sheet on a previously printed side thereof, the dressing being a foil formed with a textured surface for supporting the sheet and being adaptable to and compensating for the eccentric outer cylindrical surface of the impression cylinder, so that the sheet supporting surface is concentric with the impression cylinder, the foil being selectable from a plurality of foils of varying thicknesses, in accordance with the extent to which and the direction in which the outer cylindrical surface is eccentric to the impression cylinder, and being replaceably fastened on the outer cylindrical surface of the impression cylinder.

In accordance with yet another feature of the invention, the substantially cylindrical body has an eccentricity along a diameter thereof bisecting the foil, and the foil is formed with substantially parallel opposite sides.

In accordance with a concomitant feature of the invention, the impression cylinder has an eccentricity along a diameter thereof extending transversely to a diameter thereof bisecting the foil, and the foil is formed with opposite nonparallel sides.

A number of foils having different thicknesses and, if necessary or desirable, different shapes from among which the pressman can take his choice are thus assigned to the impression cylinder so that the concentricity errors or the sum of the inequalities of the two halves of a double-sized impression cylinder are compensated for by selecting an appropriate foil.

If necessary, intended nonparallel grinding of the foils is possible by displacing the center of the grinding device so that the foil surfaces run nonparallel to one another in circumferential direction, thereby achieving a difference in thickness between the leading foil edge and the trailing foil edge, as viewed in the sheet-travelling direction. Such foils are applied to the impression cylinder in a stepped manner, e.g., arranged in three steps varying by 0.01 mm from each other. The impression cylinder can be brought into a new condition or shape, at any time, by a predetermined characterization or indication and by exchanging the foil upon detection of inequalities or defects in the shape of the impression cylinder halves, or, e.g., in case of wear and tear. This applies as well to damage occurring during production. Appropriate methods of accurately grinding the rear side of the foil are already used by companies specialized in this field. Also known heretofore are appropriate measuring devices by means of which the entire format is determinable so that the foils can be pre-selected.

Consequently, in accordance with the invention, ghosting or slurring, in the case of impression cylinders having multiple diameters, is eliminated by means of packings or foils of varying thickness.

In accordance with the invention, difficultly formed and suitably classified anti-smear foils are assigned to the impression cylinder immediately after the assembly thereof. A prime, invariable printed image is thereby attainable even for impression cylinders with multiple diameters. All printings turn out equally well.

By analogy with foils constructed for impression cylinders having a single diameter equivalent to that of the conventional plate and blanket cylinder, foils which are used in accordance with the invention of the instant application can be formed of a base layer having a high modulus of elasticity and a chromium layer having a textured surface whereon the sheet is carried.

Other features which are considered as characteristic for the invention are set forth in the appended claims.

Although the invention is illustrated and described herein as embodied in an impression cylinder having a multiple diameter, it is nevertheless not intended to be limited to the details shown, since various modifications and structural changes may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENT(s)

Figure 1:
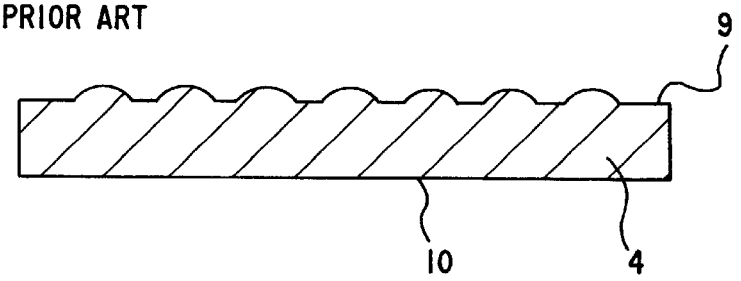
Fig.1 PRIOR ART
FIG. 1 is a cross-sectional view, in a distorted scale, of a section of a foil having surfaces which run parallel to one another according to the prior state of the art.

Referring now more specifically to the drawings and, first, particularly to FIG. 1 thereof, there is shown therein a foil 4 having parallel sides 9 and 10 and with basically uniform thickness, e.g., 0.3 mm, 0.29 mm, 0.28 mm. Such a foil 4 is shown and described in applicants U.S. Pat. No. 5,042,383, for example.

Figure 4A:
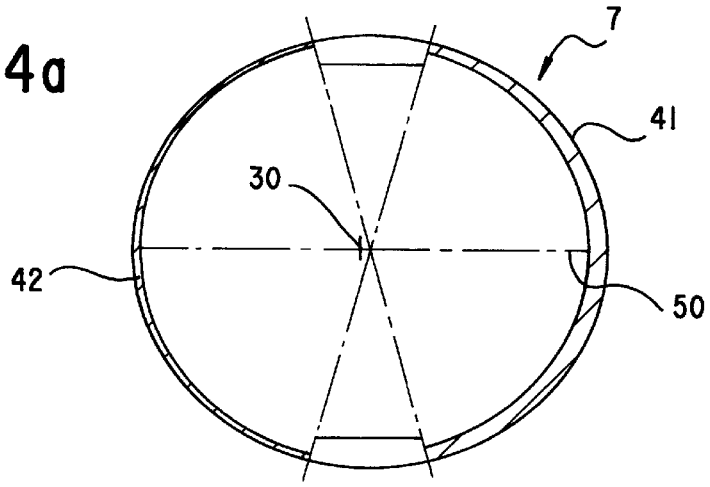
FIG. 4*a* is an end view of a double-diameter impression cylinder with two foils of the type shown in FIG. 1 mounted thereon.

Based upon suitable measurements and characterizations, two or more of the foils 4 having, respectively, different uniform thicknesses, however, may be applied to an impression cylinder in the region of a sheet-carrying surface thereof and secured in order to compensate for concentricity errors and/or inequalities of two halves of a ground impression cylinder of double-sized diameter, as shown in FIG. 4*a*.

Figure 2:
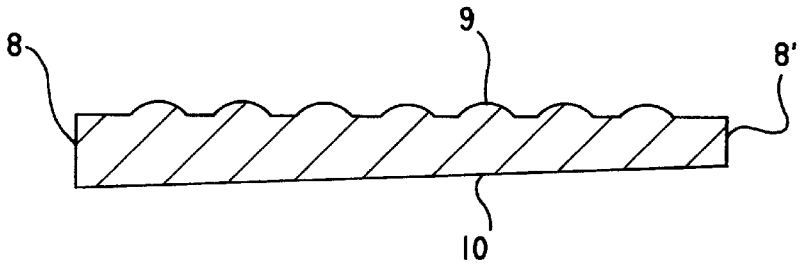
FIG. 2 is a cross-sectional view, in a distorted scale, of a section of a foil having surfaces which do not run parallel to one another.

In order to compensate for the nonconcentricity or the offset of the center of the cylinder, the opposite surfaces of the foils 4 may also run nonparallel to each other according to the view of FIG. 2 so that, e.g., the leading edge 8 has a greater thickness than the trailing edge 8', as viewed in the direction of rotation of the cylinder on which it is mounted.

Figure 4B:
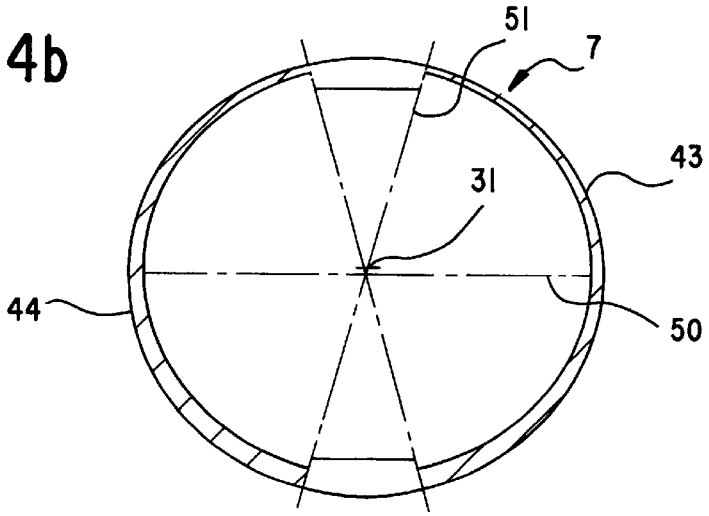
FIG. 4*b* is an end view of a double-diameter impression cylinder with two foils of the type shown in FIG. 2 mounted thereof.

Two or more of the nonparallel foils 4 may also be mounted on an impression cylinder 7 of double-sized diameter, for example, as shown in FIG. 4*b*.

As shown in FIG. 4*a*, the original center of the impression cylinder 7 has shifted to the location 30 along a diameter 50 which bisects the respective foils 41 and 42. In this regard, each of the foils 41 and 42 has mutually parallel opposite surfaces. In order to counteract the eccentricity from the original center to the location 30, the foil 41 is suitably thicker than the foil 42.

In FIG. 4*b*, however, the original center of the impression cylinder 7 has shifted to the location 31 along a diameter 51 transverse to the diameter 50 which bisects the respective foils 43 and 44. In this regard, each of the foils 43 and 44 has nonparallel opposite surfaces. In order to counteract the eccentricity from the original center to the location 31, the thicker portions of the foils 43 and 44 are located on the semi-cylindrical surface of that part of the cylinder 7 which is located on a side of the diameter 50 which is opposite from the other part of the cylinder 7 in which the eccentric location 31 is situated.

Figure 5:
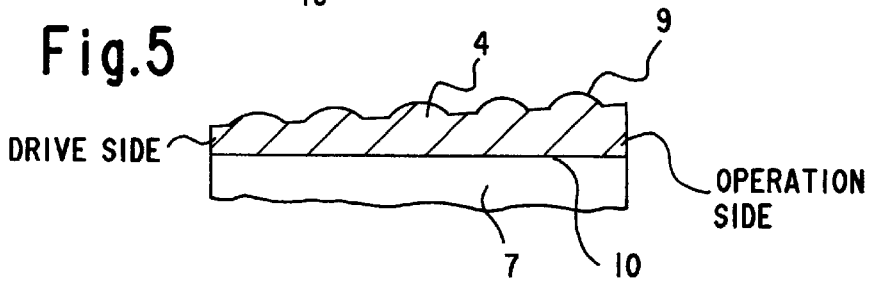
FIG. 5 is a front view of an impression cylinder having another embodiment of the foil mounted thereon.

As shown in FIG. 5, the surfaces 9 and 10 run nonparallel to one another in the axial direction of the impression cylinder 7 which results in a difference in thickness of the foil 4 between the drive side and the operation side of the printing machine.

Figure 3:
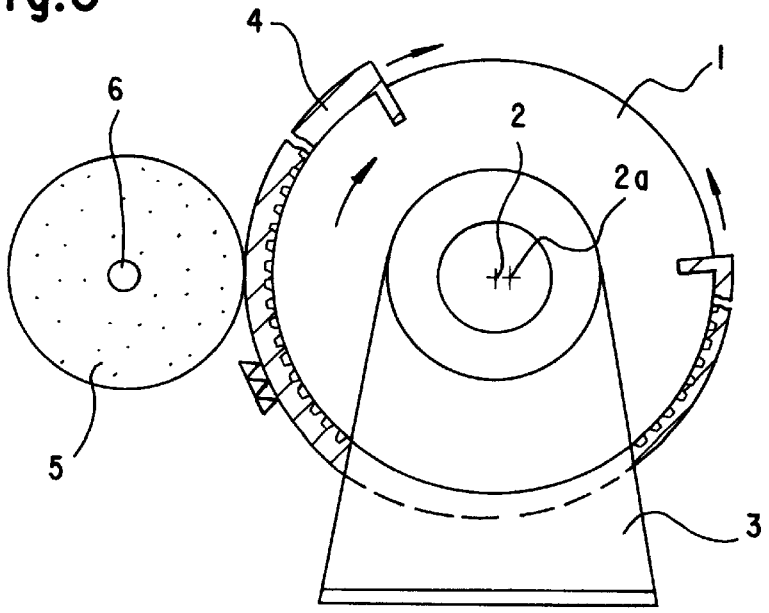
FIG. 3 is a side elevational view of a basic setup of a device for processing a foil according to the invention of FIGS. 1 and 2.

FIG. 3 shows a simplified setup of an apparatus for processing a foil 4 which forms part of the invention. The apparatus includes a grinding cylinder 1 rotatable on a shaft 2 which is mounted in a frame 3, and is provided with conventional means on the outer circumference of the grinding cylinder 1 for mounting and clamping the foil 4 to be processed. A driven grinding wheel or disk 5 having a shaft 6 which extends parallel to the shaft 2 acts on the foil 4. In order to provide the foil 4 with a nonparallel surface extending in the circumferential direction of the cylinder 1, the center of rotation of the shaft 2 in the bearing of the grinding cylinder 1 is shifted or displaced, with respect to the shaft 6 of the grinding wheel or disk 5, to a location 2*a* in the common plane of the two shafts 2 and 6.

Likewise, if necessary or desirable, the parallel position of the two shafts 2 and 6 can be modified angularly in order to obtain varying foil thicknesses on the drive side as well as on the operation side, for example, in the case of conically ground cylinders.

The foil per se may also be formed with a base layer and a top layer having the textured surface which prevents ink from accumulating and building up during perfector printing.

Figure 6:
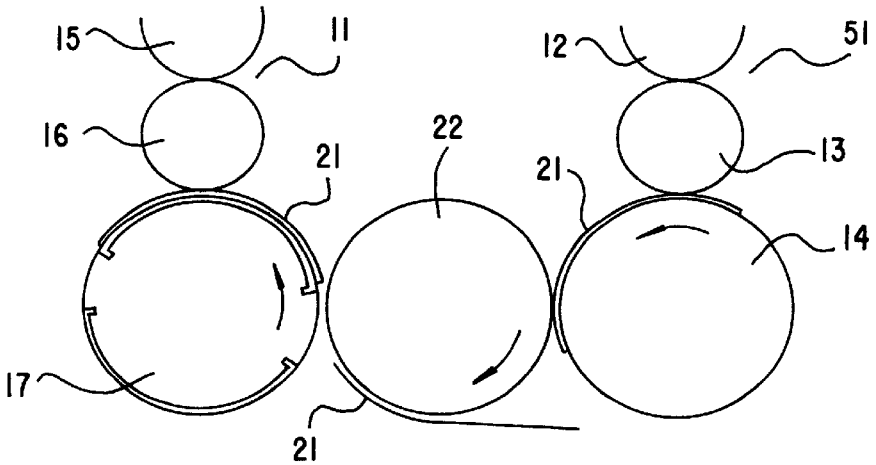
FIG. 6 is a diagrammatic side elevational view of an embodiment of a sheet-fed offset printing machine for first form and perfector printing having double-diameter impression cylinder in accordance with the invention.

An embodiment of an offset perfector printing machine is illustrated diagrammatically in FIG. 6 and has two impression cylinders 14 and 17 which are twice the diameter of the plate cylinder 12 and 15 and rubber or blanket cylinder 13 or 16. Moreover, both printing units 51 and 11 are connected solely by a sheet transfer cylinder 22 constructed as a sheet turning cylinder. The sheet 21 received its first impression or imprint, the obverse impression on the front side of the sheet, in the first printing unit 51 by means of the rubber or blanket cylinder 13 which is provided with a printing image by the plate cylinder 12. The sheet transfer cylinder 22 grips the freshly printed sheet 21 at the rear or trailing edge of the latter and transfers it turned i.e. with the rear or trailing edge thereof in forward or leading position, to the printing unit 11. The sheet 21 therefore rests upon the impression cylinder 17 with the printed front side of the sheet 21 against the cover or shell surface. Because the impression cylinder 17 is twice the diameter of the remaining printing unit cylinders 15 and 16, it has two sheet supporting cover or shell surfaces, both of which are provided with a respective foil 4. In the second printing unit 11, the sheet 21 then receives an impression or imprint on the reverse side thereof, the so-called perfection. For this purpose the previously imprinted sheet is supported by the still freshly printed front side thereof against the foil 4. Due to the construction of the foil 4 in accordance with the invention, the first impression or imprint, the so-called prime, is not impaired in quality during this second printing operation.

I claim:

1. Impression cylinder assembly of a sheet-fed offset printing machine for first form and perfecter printing, comprising: an impression cylinder having a multiple diameter of a plate and blanket cylinder and a foil disposed directly on an outer cylindrical surface thereof for carrying a sheet on a previously printed side thereof, said foil having a textured surface for supporting the sheet and having means for adjusting to and compensating for irregularities in shape of respective parts of the outer cylindrical surface of the impression cylinder, said foil being disposed directly on the outer cylindrical surface at least at a sheet carrying region thereof.

2. Impression cylinder assembly of a sheet-fed offset printing machine for first form and perfector printing, comprising: an the impression cylinder having a multiple diameter of a plate and blanket cylinder and being rotatable in a given direction, and a foil disposed directly on an outer cylindrical surface thereof for carrying a sheet on a previously printed side thereof, said foil having respective edges leading and trailing in said given rotational direction, said foil having a textured surface for supporting the sheet and having means for adjusting to and compensating for irregularities in shape of respective parts of the outer cylindrical surface of the impression cylinder, said foil being disposed directly on the outer cylindrical surface at least at a sheet carrying region thereof, said foil having a thickness varying from said leading edge to said trailing edge thereof.

3. Impression cylinder assembly according to claim 2, wherein said foil has opposite side surfaces respectively facing radially towards and away from the impression cylinder, said opposite side surfaces of said foil being nonparallel.

4. Impression cylinder assembly according to claim 2, wherein said foil is formed of an elastic base layer and a chromium layer having said textured surface.

* * * * *